US006042149A

United States Patent [19]

Roshkoff

[11] Patent Number: 6,042,149

[45] Date of Patent: Mar. 28, 2000

[54] PACKAGING LABEL AND METHOD FOR DELIVERING AN INCENTIVE ITEM

[75] Inventor: Kenneth S. Roshkoff, Villanova, Pa.

[73] Assignee: Attitude Measurement Corporation, Southampton, Pa.

[21] Appl. No.: 09/287,822

[22] Filed: Apr. 7, 1999

Related U.S. Application Data

[62] Division of application No. 09/049,692, Mar. 27, 1998, abandoned.

[51] Int. Cl.[7] ..... B42D 15/00

[52] U.S. Cl. ..... 283/67

[58] Field of Search ..... 283/67, 70, 74, 283/115, 56, 117, 51

[56] References Cited

U.S. PATENT DOCUMENTS

| | | | |
|---|---|---|---|
| 1,273,105 | 7/1918 | Van Dyke et al. . | |
| 3,250,385 | 5/1966 | Timms | 206/56 |
| 3,436,854 | 4/1969 | Wurzburg et al. | 40/10 |
| 3,525,470 | 8/1970 | Carrigan | 229/74 |
| 3,943,645 | 3/1976 | Viesturs | 40/10 D |
| 4,103,821 | 8/1978 | Gartshore et al. | 229/74 |
| 4,405,157 | 9/1983 | Bennett | 283/58 |
| 4,722,554 | 2/1988 | Pettit | 283/105 |
| 4,846,504 | 7/1989 | MacGregor et al. | 283/102 |
| 5,127,676 | 7/1992 | Bockairo | 283/81 |
| 5,263,743 | 11/1993 | Jones | 283/81 |
| 5,308,119 | 5/1994 | Roshkoff | 283/58 |
| 5,489,123 | 2/1996 | Roshkoff | 283/81 |
| 5,501,491 | 3/1996 | Thompson | 283/70 |
| 5,628,530 | 5/1997 | Thornton | 283/70 R |
| 5,865,470 | 2/1999 | Thompson | 283/70 |
| 5,918,910 | 7/1999 | Stillwagon | 283/67 |

*Primary Examiner*—Willmon Fridie, Jr.

*Attorney, Agent, or Firm*—Seidel, Gonda, Lavorgna & Monaco, PC

[57] ABSTRACT

A label for affixing to a container and delivering an incentive item is constructed from a first layer, a second layer, and an incentive item having a premium associated therewith. The second layer is attached to the first layer and encapsulates the incentive item. The first and second layers are separable to provide access to the incentive item. The second layer may have indicia thereon associated with the container and/or the incentive item. In another embodiment, the label of the present invention may include an intermediate layer to overlie and conceal the incentive item. The intermediate layer may have indicia thereon associated with the container and the incentive item. The incentive item must be activated before a purchaser may redeem the premium. In the preferred embodiment, the incentive item is activated after the purchaser provides consumer related data to a validating entity.

2 Claims, 5 Drawing Sheets

PACKAGING LABEL AND METHOD FOR DELIVERING AN INCENTIVE ITEM

This is a divisional of application Ser. No. 09/049,692 filed on Mar. 27, 1998 now abandoned.

FIELD OF THE INVENTION

The present invention relates to a label designed to be placed on a container. In particular, the invention relates to a label for delivering an incentive item on a container, the incentive item being used as a means of collecting consumer related data.

BACKGROUND OF THE INVENTION

Over the years, manufacturers and retailers have used many methods to entice consumers to purchase products offered in the market. One such method involves the art of using premiums.

Premiums offer the consumer the opportunity to receive materials of value generally associated with the purchase of a product. Typically, the materials of value include coupons, sweepstakes, mail-in rebates or other items such as inexpensive toys. The materials of value are often concealed from the immediate sight of the consumer as part of the lure to get the consumer to purchase the product. For instance, it is known in the art that cereal manufacturers will hide inexpensive toys or games inside a box of cereal as a means to encourage young children to choose a particular brand of cereal over another. Usually associated with the inexpensive toys or games hidden in the box of cereal is some form of printed advertisement to alert the young children or the adult that a material of value is contained inside and available after the point of purchase.

Premiums have become well known in the art as "incentives" to induce sales. Recently, premiums have taken on different forms from the traditional coupons, sweepstakes, or mail-in rebates. Today, telephone calling cards, debit cards, and now smart cards are available as premiums that offer free telephone use or credit as a material of value to entice consumers (i.e., normally more mature purchasers), to buy a product. More and more, these new forms of premiums are being offered by manufacturers and retailers as incentives to increase the sale of products.

The delivery of the premiums to the consumers is also an art. Packaging labels to deliver premiums to consumers in order to generate sales is a practice frequently used by many manufacturers and retailers. Typically, premiums such as coupons, mail-in rebates, sweepstakes entry forms, product literature, or related product information have been delivered to consumers in multi-panel labels or expanded content labels affixed to a container. U.S. Pat. Nos. 3,250,385, 3,436,854, 3,525,470, 3,943,645, and 4,103,821 disclose examples of such labels. Collectively, these patents disclose the use of an adhesive envelope or package to affix to a container and having a transparent cover sheet for containing, mounting, and protecting display material such as advertising sheets, packaging slips, advertising posters, and data cards.

As another example, U.S. Pat. No. 4,846,504 shows a label assembly for affixing to a container or package that includes concealed promotional material. The label assembly includes a backing strip, a coating of release material on the backing strip, at least one base label bearing advertising printed material mounted on the backing strip, a coating of adhesive on the outer surface of the base label, and an outer label to secure to the base label. The promotional material may be disposed between the base label and the outer label.

U.S. Pat. No. 5,127,676 shows a label, either of a round or rectangular configuration, to affix to a container having a base layer, a transparent cover sheet, and a folded indicia-bearing strip such as a coupon.

However, a problem associated with packaging labels as represented by the foregoing patents is that they may often obscure the product information portion (such as the product name, information disclosure labels, ingredient lists, and warning instructions) of the container or the container's original label on which they are affixed. Contributing to this problem are new government laws to protect consumers which require manufacturers and retailers to display additional information related to the product. The additional information disclosed to the consumers as required by the new government laws are not to be concealed or obscured both before and after the purchase of the product. Due to the combined demands of the manufacturer and retailer to display both the product information portion of the container and the information required by the government, the amount of space otherwise available to affix packaging labels that include premiums is reduced. This problem is particularly serious when the containers are small. As yet another problem, manufacturers and retailers use containers that are curved, thus making the art of attaching a packaging label even more difficult.

To be effective, packaging labels to attach to a container must be adaptable to the myriad of containers that are used by manufacturers and retailers in the market. Moreover, packaging labels must not conceal or obscure the underlying label or product information portion of the container both before and after the premium is removed. Accordingly, there is a need in the art for a label that can deliver a premium to the consumer that includes the additional feature of being adaptable to different configurations of containers and avoids obscuring the label or product information associated with the container.

Generating sales of products by offering free premiums is not the only part of a manufacturer's and retailer's marketing efforts. Increasingly, manufacturers and retailers seek information regarding the purchasing decisions made by consumers. Typically, the purchase of products or services involves a decision by the particular consumer to choose a particular product offered by one manufacturer or retailer over another. The frequency with which a particular product is purchased by a consumer relates to the ultimate success or failure of the product in the market place. In order to better understand the purchasing decisions made by consumers, manufacturers and retailers increasingly seek to collect consumer related information about the products consumers buy and the reasons consumers like or dislike certain products. Manufacturers and retailers use the information as a way of improving marketing efforts, improving a product, developing new products, or determining the characteristics or profile of the typical consumer.

Manufacturers and retailers have increasingly used the consumer's point of purchase of a product as a means of obtaining consumer related data. Traditionally, manufacturers and retailers have used surveys as a method of collecting this information. In some cases, a survey is done by personally interviewing consumers about their purchases and preferences. This type of survey is usually done at a retail outlet or as the consumer is leaving the store. In order for the survey to be effective, the survey must be taken by experienced survey takers who are schooled in the art of asking questions and eliciting a response that will be beneficial to the manufacturer and retailer. Often, however, consumers have little interest in taking time out of shopping to answer a series of questions, particularly if there is no incentive or value to be derived from their participation. Thus, a problem associated with obtaining consumer related information from the consumer is actually enticing the consumer to voluntary participate in the survey.

To reduce costs and to encourage consumers to participate in surveys, manufacturers and retailers have used sweepstakes entry forms or rebate coupons to deliver surveys to consumers. This type of survey is less expensive than the ones which require personal interviews, but nevertheless has drawbacks. This type of survey is characterized by low participation. Even the responses that are mailed in may not be helpful to the manufacturer or retailer because the consumer may not have understood the questions or may have provided inaccurate responses. Thus, there is a need to elicit consumer information that is cost effective and will provide accurate information to the manufacturer and retailer.

One method of conducting surveys or collecting consumer related information to increase the reliability and usefulness of the response, in addition to cutting costs, is the telephone survey. Through this format, a person experienced in conducting surveys and recording information may ask a series of questions and immediately record the responses. Also, the telephone survey gives the interviewer the freedom to answer calls and conduct surveys for a much broader audience, more likely than not from around the country. The advantages associated with using the telephone survey is obvious. The costs of conducting the survey are reduced and the information recorded will be less susceptible to incorrect responses because professional persons will conduct the actual survey. Similar types of surveys can also be taken through the internet or other electronic means in which responses are recorded in computer readable form.

Nonetheless, the problem of how to get the consumer to participate in the telephone survey or to provide consumer related data remains. It continues to be desirable to deliver to the consumer a premium affixed to a container as a way of encouraging the consumer to participate in the survey. Thus, the ability to quickly and accurately obtain information from consumers regarding the purchase of a specific product is a challenge that remains in the art.

Accordingly, there continues to be a need for a system to deliver a packaging label and incentive that is adaptable to the myriad of configurations of the containers used by manufacturers and retailers. Also, there continues to be a need in the art for a packaging label containing an incentive or a premium that does not obscure the underlying display information section of the container. Further, there is a need for an incentive delivery system that both draws the consumer's attention to the incentive or premium within the packaging label while not explicitly revealing its presence in a retail store. Furthermore, there is a need for a packaging label which can deliver an incentive or premium to the consumer to elicit and require the consumer to participate in a survey in order to redeem the premium. The present invention fills those needs.

SUMMARY OF THE INVENTION

The present invention comprises a label for a container including a first layer, a second layer, and an incentive item. The first layer has an outer surface facing the container and oppositely disposed edges. The first layer has an adhesive for affixing the label to the container. The second layer is joined to the first layer along at least a portion of the oppositely disposed edges of the first layer to form an interior space. The incentive item is provided in the interior space. The second layer is separable from the first layer along at least a portion of the oppositely disposed edges for providing access to the interior space. Joining the second layer to the first layer encapsulates the contents of the interior space which, for purposes of the present invention, includes at least the incentive item.

The incentive item has a redeemable premium associated therewith. The incentive item also has indicia thereon associated with the container. The indicia may also include instructions for activating the item in order to redeem the premium.

In one embodiment, the incentive item must be activated by the purchaser before the premium may be redeemed. The incentive item, such as a telephone calling card, is activated after the purchaser participates in a survey, preferably a telephone survey. At the conclusion of the survey, the purchaser receives an access code that will enable the telephone card to be activated. Once activated, the purchaser may enjoy a fixed amount of free local and long distance telephone calls, or other services.

In the preferred embodiment, at least a portion of the second layer is transparent so that the consumer may read the indicia on the incentive item. Alternatively, the second layer may be opaque and/or have indicia that includes information associated with the container and the incentive item. In such an embodiment, the indicia will provide instructions for gaining access to the incentive item and redeeming the premium. The indicia may also include a bar code or other electronically or optically readable marks that identify the product which duplicates the product identification marks of the container.

In another embodiment, the incentive item may include an intermediate layer to overlie and conceal the incentive item. The intermediate layer will have indicia thereon associated with the container and incentive item. In the preferred embodiment, the indicia on the intermediate layer will include product identification information associated with the container such as the name of the product or instructions for removing and activating the incentive item. The indicia associated with the container may contain substantially similar information that may appear on the label of the container. Also in the preferred embodiment, the indicia associated with the incentive item will include instructions for accessing and activating the incentive item in order to redeem the premium.

In yet another embodiment, the present invention defines an incentive item delivery system and label having a package, a removable incentive item, and a first layer. The package has an outer surface, an adhesive on the outer surface for affixing the package to the container, an interior space, and oppositely disposed edges. The incentive item has a premium associated therewith and indicia thereon. The incentive item is provided in the interior space and, in a preferred embodiment, must be activated before the premium can be redeemed. The intermediate layer overlies and conceals the incentive item from the consumer. The incentive item may have indicia thereon that is associated with the container and the incentive item. The package is transparent so that the indicia of the intermediate layer may be read by the consumer when the package is affixed to the container. The package is attached along at least a portion of the oppositely disposed edges to enclose the incentive item and the intermediate layer. The package is also separable along at least a portion of an oppositely disposed edge so as to provide access to the intermediate layer and the incentive item.

In yet another embodiment, the oppositely disposed edges may be folded over the edges of the intermediate layer and/or the incentive item to overlie the outer surface of the first layer. The adhesive for affixing the label to the container will overlie both the oppositely disposed edges and the first layer. Similar to the embodiments discussed above, the indicia on the intermediate layer and/or the incentive item will continue to be visible, as seen through the second layer. In this embodiment, the oppositely disposed edges are no longer visible to the consumer when the label is affixed to the container. As a result, the label will have a more defined and a neater appearance that may be more appealing to the consumer.

In yet another embodiment, the present invention defines a method for collecting consumer related data comprising the steps of: (a) affixing to a container a label assembly having an outer surface, an interior space, an incentive item in the interior space and an intermediate layer to overlie and conceal the incentive item; (b) providing instructions to a consumer for accessing the incentive item; (c) providing instructions to the consumer for activating the incentive item by supplying consumer related data to a validating entity; (d) collecting the consumer related data from the consumer; and (e) activating the incentive item to redeem the premium, preferably after the data from the consumer has been received.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

While the invention is described herein in connection with a preferred embodiment, it is understood that it is not intended to limit the invention to that embodiment. To the contrary, it is intended to cover all alternatives, modifications and equivalents as may be included within the spirit and scope of the invention as defined by the appended claims.

The term "incentive item" as used herein is meant to include an article entitling the bearer to receive a premium of a fixed amount of goods or services, wherein the article at the option of the manufacturer or retailer must be activated before the bearer may redeem the value of the premium. The article may be activated by participating in an interview or a personal or telephonic survey.

The term "incentive item" includes prepaid telephone calling cards, debit cards, negotiable instruments, and smart cards. Telephone calling cards are characterized in that the consumer has access to a pre-set number of minutes to make local or long distance calls. Debit cards are characterized in that the consumer has access to credit or money's worth that may be used in connection with the purchase of products.

A negotiable instrument is characterized by offering the consumer an unconditional promise or order to pay a fixed amount of money. It includes checks, money orders and the like. Finally, the term "smart card" is meant to include those classes of cards that, in addition to offering to the consumer some type of redeemable credit, includes a microprocessor that stores information such as the name and address of the consumer, a record of the purchases made by the consumer, and other forms of information that may indicate the profile of the consumer.

In all, the incentive item as contemplated by the present invention is clearly distinguishable from the traditional coupons, sweepstakes entry forms, or mail-in rebates. These more traditionally used materials of value do not in all cases require the consumer to participate in a survey or to provide consumer related data as a condition to redeeming the premium. Nevertheless, the present invention may be used with the more traditional materials of value.

Figure 1:
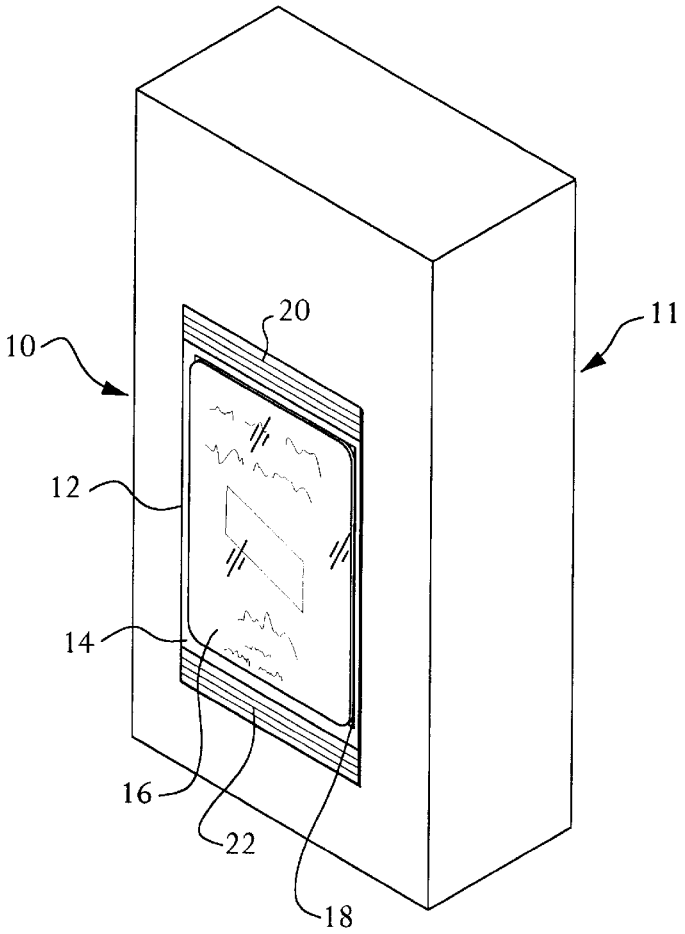
FIG. 1 is a perspective view of a preferred form of label in accordance with the present invention affixed to a container.

Turning now to the figures, where like numerals identify elements, there is shown various views of the label affixed to a container for delivering an incentive item. FIG. 1 shows a perspective view of an exemplary label 10 which incorporates the novel features of the present invention. Label 10 comprises the following parts: a first layer 12, a second layer 14, an intermediate layer 16, and an incentive item 18. The first layer 12 and the second layer 14 are made of transparent plastic material. In an alternative embodiment, the second layer 14 may be opaque. Of course, in order for the consumer to read or see the intermediate layer 16 and the incentive item 18, at least the second layer 14 will have to be transparent or clear.

Using both a transparent or clear first layer 12 and second layer 14 contributes to an additional feature of the present invention. When the incentive item 18 and the intermediate layer 16 are removed, the label 10 may remain on the container 11. Since the first layer 12 and the second layer 14 are transparent or clear, the label of the container 11 over which the label 10 may be affixed is not obscured. Thus, the label 10 may remain affixed to the container 11 and will fulfill the need in the art for a label that does not obscure the product information portion of a container.

Figure 2:
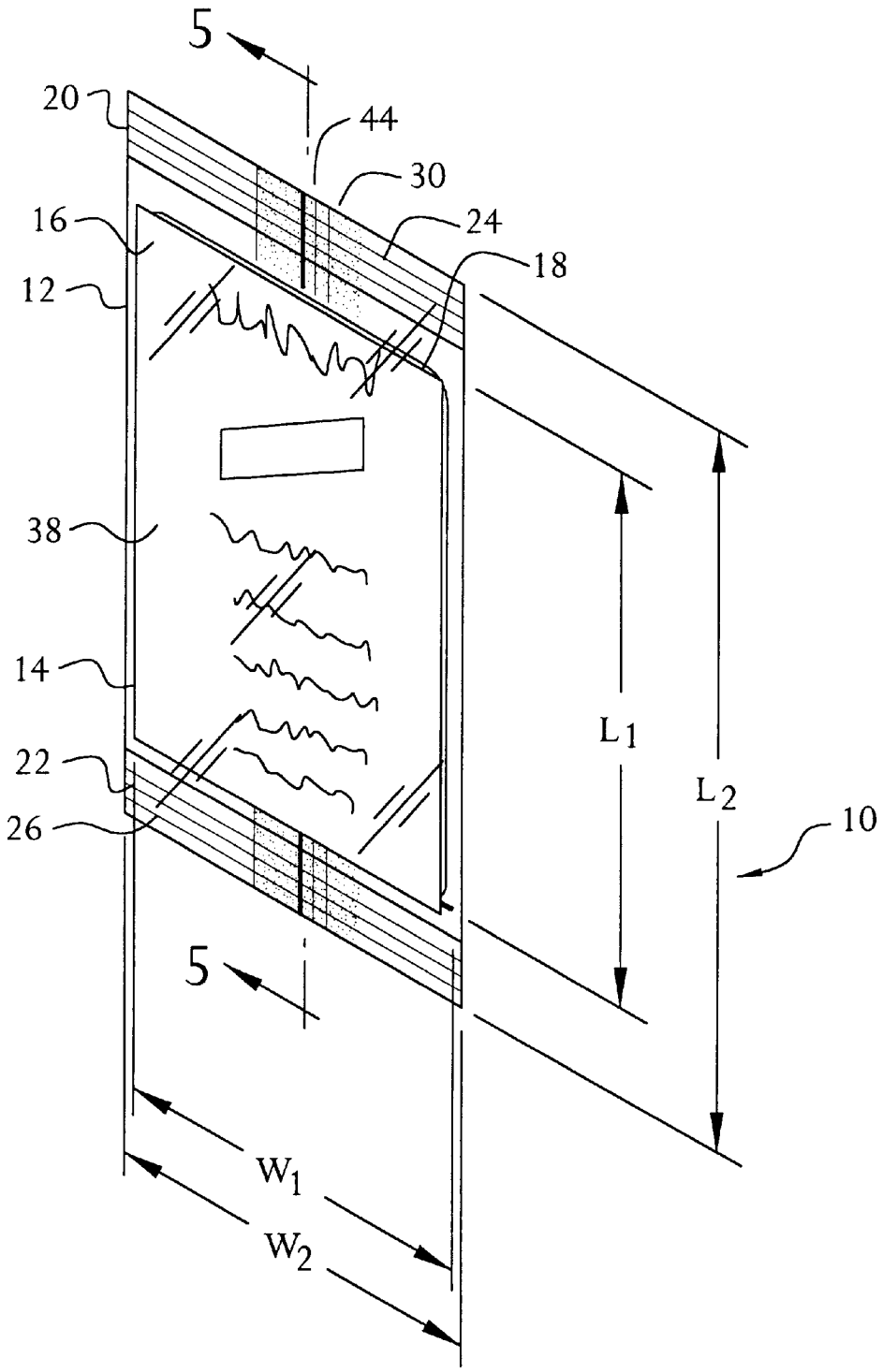
FIG. 2 is an isolated perspective view of the label shown in FIG. 1.

As more particularly illustrated in FIG. 2, the first layer 12 has length $L_2$ and width $W_2$ which helps to define the perimeter of the label 10. The first layer 12 has oppositely disposed edges 20 and 22. The precise length $L_2$ and width $W_2$ is not critical for the purposes of the description of the preferred embodiment of the present invention. However, the length $L_2$ and width $W_2$ of the present invention should have dimensions consistent with the type of container 11 on which the label 10 will be affixed.

Figure 3:
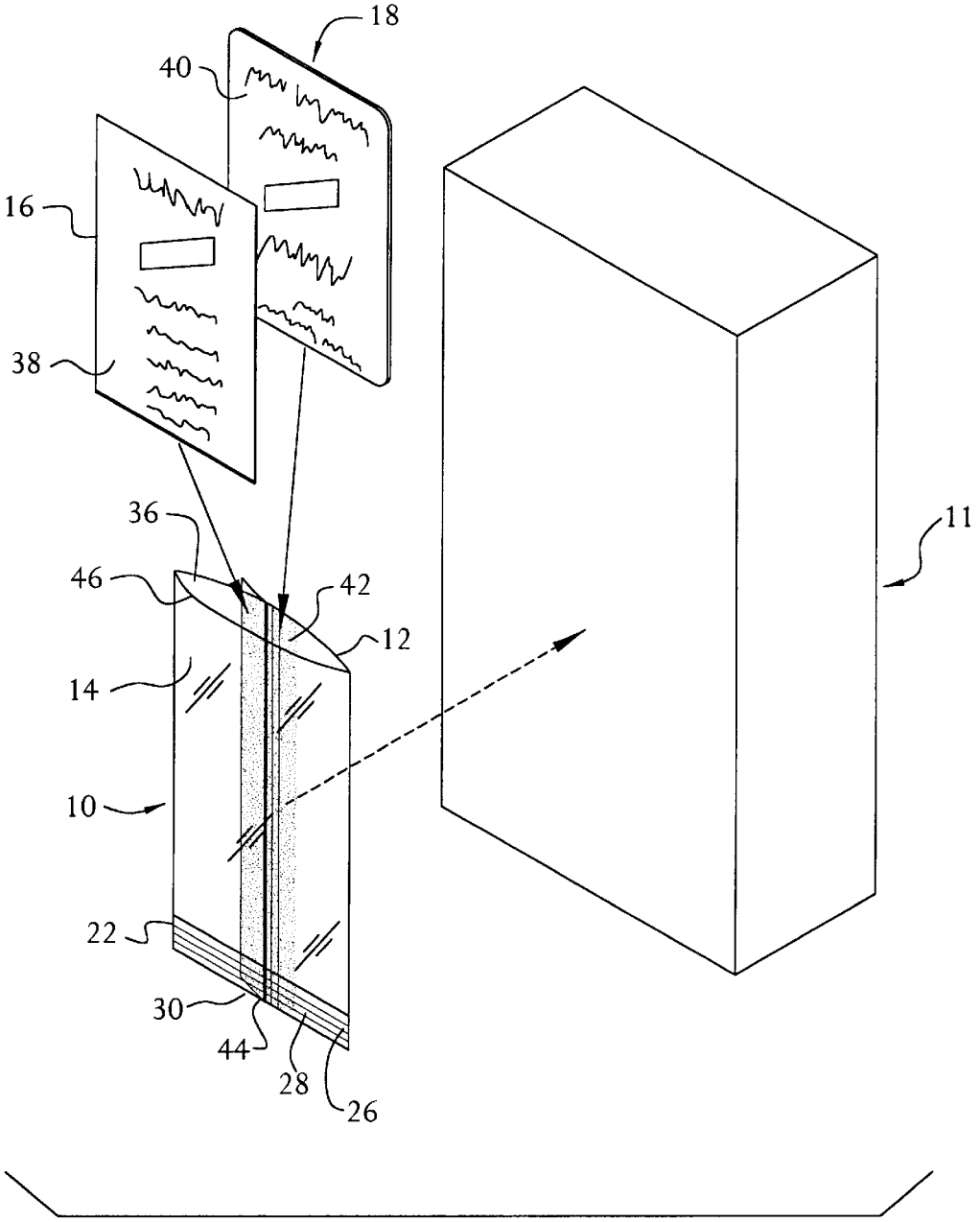
FIG. 3 is a front perspective view of the label shown in FIG. 1 with the intermediate layer and the incentive item external to the label.

Adhesion of the label 10 to the container 11 is obtained by a suitable adhesive on the back of the first layer 12. In the preferred embodiment, the first layer 12 and the second layer 14 are part of a package that has spine section 30 which extends between the oppositely disposed edges 20 and 22 (see FIGS. 2 and 3). The spine 30 defines the central axis of the label 10 and the first layer 12. As depicted in FIGS. 2 and 3, the adhesive material 42 is on the spine 30 so that the first layer 12 may be affixed to the container 11. The adhesive material, which may be any pressure sensitive adhesive, is well-known in the art. Before mounting the label 10 on the container 11, wax-coated or plastic coated release paper 50 may be applied to overlie the adhesive 42 on the spine 30 to store the label 10 (see FIG. 4). The release paper 50 may be easily peeled off thereby exposing the adhesive 42 of the spine 30. The label 10 can also be affixed to the container 11 using other means. Since the specific adhesive 42 or the means by which the label 10 is affixed does not form any critical part of the present invention and is well-known in the label-affixing art, no further description is needed.

Figure 4:
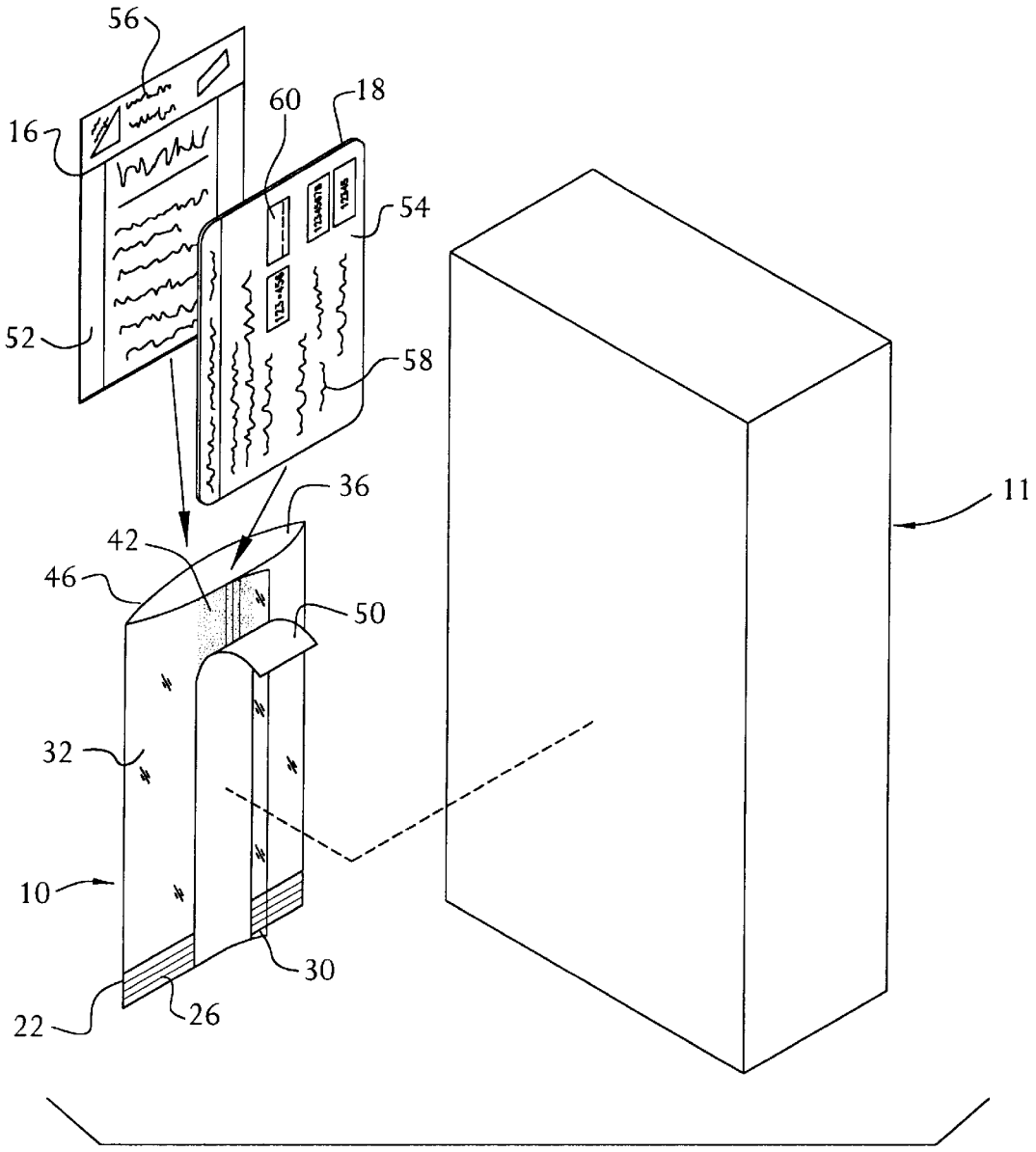
FIG. 4 is a rear perspective view of the label shown in FIG. 1 with the intermediate layer and the incentive item external to the label.

Joining the second layer 14 to the first layer 12 along at least a portion of the oppositely disposed edges 20 and 22 forms a package having an interior space 36 (see FIGS. 3 and 4). The oppositely disposed edges 20 and 22 have molded ribs 24 and 26 to enhance the strength of the bond between the oppositely disposed edges. The second layer 14 is further characterized in that it is separable along at least a portion of the oppositely disposed edges 20 and 22 to form a separation line 46 which provides access to the interior space 36.

The package may be formed from either a single layer of material having a plurality of fold lines which divide the single layer into a plurality of foldable panels. Folding the panels will define the first layer 12 and the second layer 14. In the alternative, the package may be formed from a tube of material having a continuous outer surface that is cut and sealed to form oppositely disposed edges 20 and 22. The precise manner in which the package is formed is not critical, it being understood that the package may be embodied in other specific forms without departing from the spirit and attributes of the present invention.

Returning to FIG. 2, the second layer 14 will have the same relative dimensions as the first layer 12 in terms of length $L_2$ and width $W_2$. However, the precise dimensions of the first layer 14 are not critical so long as when the second layer 14 is joined to the first layer 12 the package is formed having an interior space 36 which may be enclosed by joining the oppositely disposed edges 20 and 22.

Also depicted in FIG. 2 are the intermediate layer 16 and the incentive item 18. Both the intermediate layer 16 and the incentive item 18 have the same relative dimensions of length $L_1$ and width $W_1$ which are less than the dimensions $L_2$ and $W_2$ of the first layer 12. As a result, the intermediate layer 16 and the incentive item 18 can be easily removed from the interior space 48. The dimensions of the intermediate layer 16 and the incentive item 18 are chosen to easily fit within the interior space 36.

FIG. 2 is also helpful in illustrating the relative dimensions of the intermediate layer 16 to the incentive item 18. As shown in FIG. 2, the intermediate layer 16 overlies and conceals the incentive item 18 within the interior space 36 so that only the outer edges of the incentive item 18 can be seen by the consumer. This concealment feature is part of the lure of the present invention which will secure the premium to the product and help deter pilferage of the premium. As an additional feature shown in FIG. 2, the intermediate layer 16 has indicia 38 which faces away from the container 11 and faces the customer. The indicia 38 may comprise written material or graphics and may alert the consumer that a redeemable premium is enclosed. The indicia may also provide instructions which explain to the consumer how to gain access to the incentive item 18. In the preferred embodiment, the indicia of the intermediate layer 16 that faces the consumer will be the same as on the panel of the container 11 or the original label of the container 11 on which label 10 is attached. Thus, the indicia 38 of the intermediate layer 16 may contain all pertinent information relating to the container on which label 10 is affixed that is otherwise traditionally used by manufacturers on a particular product.

In an alternative embodiment, the intermediate layer 16 does not have to be used. Rather, the label 10 may include only the incentive item 18 provided in the interior space 36. In that embodiment, the incentive item 18 may have indicia 40 which faces away from the container 11 to the customers. The indicia 40 of the incentive item 18 may contain all of the information that would otherwise be contained on the indicia 38 of the intermediate layer 16. This may contribute to a reduction in the costs to manufacture the label 10 of the present invention. Thus, the indicia 40 of the incentive item 18 may include an advertisement, duplicate the product identification portion of the container 11, or provide instructions for redeeming the premium.

FIG. 3 depicts a front perspective of the label 10 with the incentive item 18 and the intermediate layer 16 external to the interior space 36. The indicia 38 of the intermediate layer 16 faces the second layer 14 of the label 10 and thus alerts the consumer to the incentive item 18 enclosed. In the exemplary embodiment shown in FIG. 3, a portion of the oppositely disposed edges 20 or 22 is separated to provide access to the interior space 36 and/or the intermediate layer 16 and the incentive item 18.

The indicia 38 on the intermediate layer 16 may contain an advertisement that alerts the consumer that he or she may receive a premium or some type of offer from the manufacturer or retailer after or contemporaneously with the purchase of the product. Also, the indicia 38 may provide the consumer with instructions for removing the intermediate layer 16 and the incentive item 18. Critically, as a feature of the present invention, the indicia 38 will duplicate the same product information, graphics, trade names, or trademarks that would otherwise appear on the label of the container 11. In the event the intermediate layer 16 is not used, all of the indicia discussed above may appear on the indicia 40 of the incentive item 18.

As is more particularly illustrated in FIG. 4, label 10 is shown from the rear side in which the indicia 56 on the rear side 52 of the intermediate layer 16 and the indicia 58 on the rear side 54 of the incentive item 18 can be observed. The indicia may contain instructions for using the product contained within container 11. This view also reveals the area over which the adhesive 42 may be applied in order to releasably secure the label 10 to the container. The releasable adhesive may be applied to the spine 30 of the first layer 12 or over substantially the entire area to be occupied by the first layer 12.

In FIG. 4, the intermediate layer 16 and the incentive item 18 are shown external to interior space 36 of the label 10. Direction lines illustrates the placement and orientation of the intermediate layer 16 and the incentive item 18 in the interior space 36 of the label 10. The indicia 58 of the rear side of the incentive item 18 and the indicia 56 of the intermediate layer 16 may thank the consumer for purchasing the product and describe that he or she may be entitled to redeem the premium by activating the incentive item 18 by calling a toll-free number and answering a series of brief questions. The indicia may also indicate that the premium associated with the incentive item 18 is the manufacturer's or retailer's way of saying "thank you" for participating in the survey. The indicia 58 that appears on the rear side 54 of the incentive item 18 will contain information associated with or the steps for activating the incentive item 18 to redeem the premium to a validating entity. For example, the indicia 58 may include the toll-free telephone number, the specific times to call to activate the incentive item 18, and a space 60 for entering an access code and personal identification number that serve as part of the means to activate the incentive item 18. Other types of product information can also be included.

Figure 5:
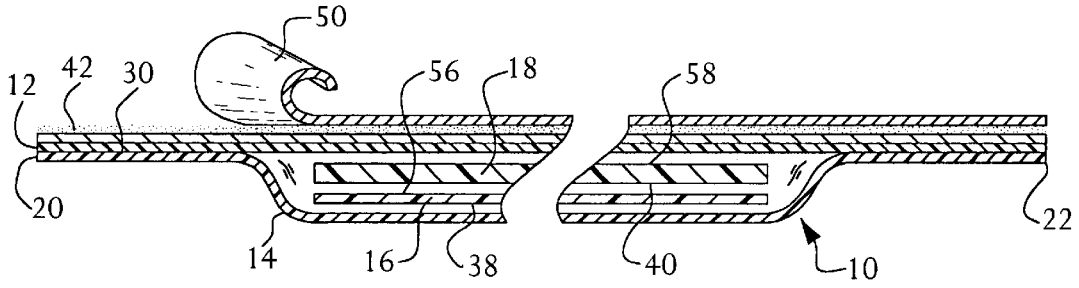
FIG. 5 is a side view of the label as shown in FIG. 1 taken along line 5—5 in FIG. 2.

FIG. 5 depicts a side view of the unopened label 10 taken alone axis line 5—5 of FIG. 2. This view shows the four parts: first layer 12, second layer 14, intermediate layer 16, and the incentive item 18. Adhesive 42 applied to the spine 30 is shown, and the release material 50 is shown partially pulled to expose the adhesive 42.

Figure 6:
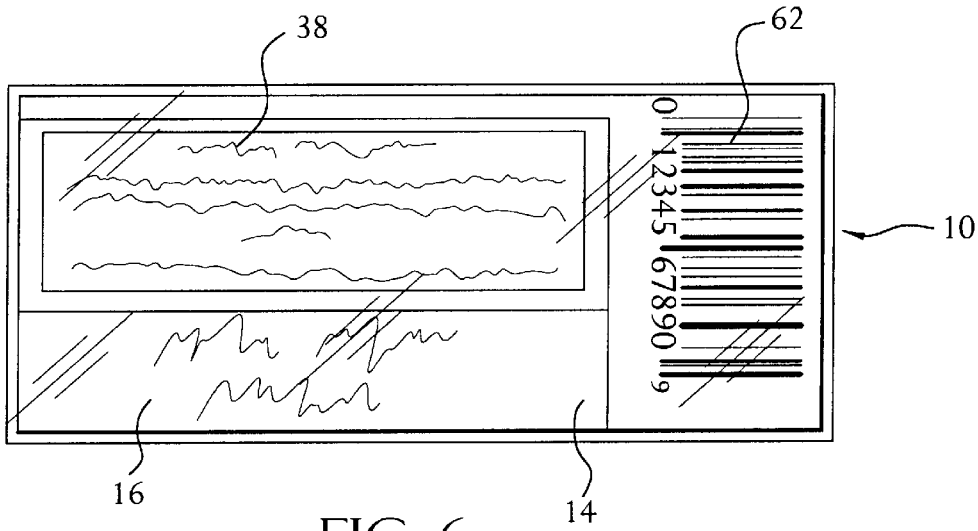
FIG. 6 is a front view of an alternative embodiment of the label of the present invention.
Figure 7:
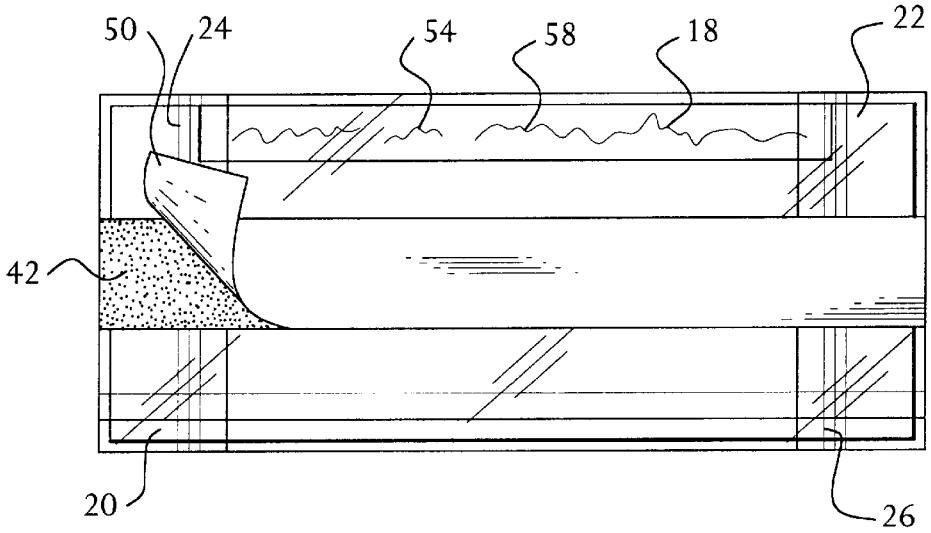
FIG. 7 is a rear view of the label shown in FIG. 6.

FIG. 6 illustrates a front view of another embodiment of the label 10 of the present invention. The oppositely disposed edges 20 and 22 are folded over the edges of the intermediate layer 16 and/or the incentive item 18. As seen in FIGS. 6 and 7, the oppositely disposed edges 20 and 22 will overlie a portion of the first layer 12. To affix the label 10 of this embodiment to the container 11, adhesive material 42 is applied to the folded oppositely disposed edges 20 and 22, the first layer 12, and the spine 30 (not shown). Release paper 50 may be used to overly adhesive 42 until the label 10 is required to be affixed to the container 11. Consistent with the other embodiments described above, the adhesive 42 may be applied to any portion of the folded oppositely disposed edges 20 and 22, the first layer 12, and/or the spine 30. Other methods or means of affixing the label 10 to the container 11 may be used consistent with the present invention.

With further reference to FIG. 6, the indicia 38 of the intermediate layer 16 faces the consumer and, as illustrated, includes a bar code 62 or other optically and/or electronically readable indicia. With the oppositely disposed edges 20 and 22 folded over, the label 10 has a more defined and a neater appearance that, when used, may be more appealing to the consumer. In addition, folding the oppositely disposed edges 20 and 22 may make the label 10 when affixed to the container 11 less susceptible to damage or being inadvertently pulled off.

FIG. 7 illustrates the rear view of the label 10 illustrated in FIG. 6. The release paper 50 is shown as being partially peeled off to expose the adhesive 42. FIG. 7 shows the position of the oppositely disposed edges 20 and 22, after being folded. Also, FIG. 7 illustrates the area over which the adhesive 42 is applied. As shown, the adhesive 42 extends approximately the length of the incentive item 18 approximately intermediate the folded portion of the oppositely disposed edges 20 and 22.

For purposes of further illustration only and not limitation, either the intermediate layer 16 or incentive item 18 can have indicia on both sides. The indicia 38 or 40 that faces away from the container toward the consumer can duplicate the product display portion or label of the container. The indicia can also include any combination of advertising statements (such as "FREE Phone Card Offer", "Hurry, Limited Offer" and "Special Offer from [ABC Company]") which alert the consumer that a premium may be obtained after the point of purchase. The indicia can also include directions for using the product. As an additional feature of the present invention, the indicia on the sides of the intermediate layer 16 and the incentive item 18 (in this discussion being a telephone calling card) may include the particular colors of the container or of the container's original label that the manufacturers and retailers use to market and advertise its product. In that way, the use of the label will be consistent with and reflect the marketing efforts used by the manufacturer. It should be further noted that the indicia may include a bar code or other electronically or optically readable product identification marks used by the manufacturer or retailer.

The novel label of the present invention has other possible uses. The label could serve as a purchasing enticement vehicle. The three-dimensional nature of the multi-layer label provides a visible, physical indication to the consumer that the purchase of a particular product includes some form of a bonus. The indicia on either the intermediate 16 or the incentive item 18 can communicate that message to the consumer. Furthermore, the second layer 14 of the label 10 can also have indicia for displaying product information and information associated with the container 11 or incentive item 18, thus further minimizing the costs associated with using the intermediate layer 16. In this manner, the label 10 serves as a label for the underlying product and an effective display and container for the incentive item 18.

Additionally, the label 10 can be removed from the container and used to protect the incentive item 18 when carried by the consumer. Moreover, since the label is transparent in the preferred embodiment, leaving the label 10 affixed to the container 11 will not obscure consumer's ability to see and read the underlying original label of the container 11.

The novel packaging label described above provides significant advantages not contemplated by prior art packaging labels. Virtually any product container can now be used as a delivery system without concern for any unintentional obscuring of the container's original label. If the label or its contents is removed prior to purchase, the label can server to alert the retail store that tampering has occurred.

For purposes of illustration and discussion, the incentive item depicted in FIGS. 1 to 5 is a prepaid telephone calling card that must be activated in order to redeem the premium. The incentive item may optionally be any form of a debit card, a negotiable instrument, or a smart card having a premium associated therewith, wherein the premium may not be redeemed or activated until consumer related data is provided, such as through a survey.

In accordance with one method of using the present invention, label 10 is provided on a randomly selected number of products, in which the incentive item 18 is a prepaid telephone calling card. Instructions are provided either on the indicia 56 of the intermediate layer 16 or on indicia 58 of the incentive item 18 directing the recipient of the incentive item 18 to dial a telephone number. Dialing the telephone number connects the recipient with either a live operator or an interactive voice response system. At that time, the recipient participates in a survey and/or provides consumer related data about the purchase of the product. At the end, instructions are given to the recipient to activate the incentive item 18 by giving the recipient an access code which enables the recipient to enjoy a fixed number of minutes of free long distance telephone calling or other services. When the calls are expended, the recipient has the option of either disposing of the incentive item 18 or refreshing the incentive item by making a monetary payment or participating in a survey for further market research.

The present invention may be embodied in other specific forms without departing from the spirit or essential attributes thereof and, accordingly, reference should be made to the appended claims, rather than to the foregoing specification, as indicating the scope of the invention.

I claim:

1. A method for collecting consumer data comprising the steps of:

(a) affixing to a container a label assembly having an outer surface, an interior space, an incentive item including a premium associated therewith, an intermediate layer to overlie and conceal the incentive item, and an adhesive on a portion of the outer surface for affixing the label assembly to the container, (b) providing instructions to a consumer for accessing the incentive item, (c) providing instructions to the consumer for activating the incentive item by supplying consumer related data to a validating entity, (d) collecting the consumer data from the consumer, and (e) activating the incentive item to redeem the premium after the data from the consumer has been received.

2. The method as claimed in claim 1 wherein the consumer data collected from the consumer is through use of a survey.

* * * * *